United States Patent [19]

Carey

[11] Patent Number: 5,009,133

[45] Date of Patent: Apr. 23, 1991

[54] SURFACE PROTECTIVE FASTENER TOOL

[76] Inventor: David R. Carey, 17052 - 4th NE., Seattle, Wash. 98155

[21] Appl. No.: 362,760

[22] Filed: Jun. 7, 1989

Related U.S. Application Data

[63] Continuation-in-part of Ser. No. 219,088, Jul. 14, 1988, abandoned.

[51] Int. Cl.[5] ..... B25B 13/58

[52] U.S. Cl. ..... 81/180.1; 81/121.1

[58] Field of Search ..... 81/180.1, DIG. 5, 121.1, 81/181.1, DIG. 11, 185, 196, 124.4, 124.6, 57.14

[56] References Cited

U.S. PATENT DOCUMENTS

| | | | |
|---|---|---|---|
| D. 246,415 | 11/1977 | Critcher | D8/29 |
| 4,030,383 | 6/1977 | Wagner | 81/57.14 |
| 4,714,138 | 12/1987 | Zaccone | 81/121.1 |
| 4,825,732 | 5/1989 | Arnold | 81/DIG. 5 |

OTHER PUBLICATIONS

Jensen, *Fall Catalog* 1977, p. 104, "Hollow-Shaft Nutdrivers".

Modern Tire Dealer, May 1988, vol. 69, No. 6, p. 52, item 108, "Socket Plus".

*Primary Examiner*—Frederick R. Schmidt
*Assistant Examiner*—Lawrence Cruz
*Attorney, Agent, or Firm*—Christensen, O'Connor, Johnson & Kindness

[57] ABSTRACT

A surface protective fastener tool for avoiding abrasion of an underlying surface as a threaded fastener is rotated by a tool. Several embodiments of the surface protective fastener tool (10, 50, 70, 100, 120, 160, 200, 240, 260, 280, 280', and 300) are disclosed, each including a sleeve that fits around the exterior of a tool used to rotate a threaded fastener. A resilient cushion or lip (38, 52, 82, 108, 128, 176, 214, 254, 270, 288, 288', 290, and 290') seats against the underlying surface (24), preventing the tool from contacting the surface as it is rotated. In one of the embodiments (70), the blade (74) of a screwdriver shaft (72) is enclosed in a sleeve (80) having an insert (86) formed around the blade and rotatable with it as the screwdriver is turned. The insert includes a cavity (88), sized to fit over the head of a threaded fastener, tending to lock the screwdriver blade in place so that it is less likely to slip from the fastener and mar an adjacent surface. In addition, the resilient cushion protects the adjacent surface in the event that the blade accidentally slips from the threaded fastener. The other embodiments are designed for use with a socket wrench (12, 102, 122, 162, 242, 264, and 282), fitting around its exterior and supporting it, so that it does not contact the underlying surface as the socket wrench is turned. Abrasion of the surface due to such contact is thereby avoided. A thermal insulating sheath (258) provided around the exterior surface of the sleeve of the surface protective fastener tool reduces heat transfer between the hand of an operator gripping the device and the fastener tool.

48 Claims, 10 Drawing Sheets

SURFACE PROTECTIVE FASTENER TOOL

This application is a continuation-in-part application based on prior copending application Ser. No. 07/219,088, filed on Jul. 14, 1988 now abandoned.

TECHNICAL FIELD

This invention generally pertains to apparatus for installing and/or removing threaded fasteners and, more specifically, to a driver tool for use with such fasteners.

BACKGROUND OF THE INVENTION

The generic term "threaded fastener" broadly encompasses any device such as a bolt, screw, or nut, which has helical threads formed on at least a portion of its surface. The installation and removal of threaded fasteners is generally accomplished using a tool of appropriate size and shape to engage the head of the fastener, so that it may be rotated. Conventional fastener tools include screwdrivers and various types of wrenches, driven either manually or by a pneumatic or electric motor. Regardless of the type of fastener or tool used, a common problem relates to the damage of an adjacent surface resulting from contact by the tool. For example, a screwdriver may slip from the head of a screw, damaging the underlying surface into which the screw is being driven, due to a worn or improperly-shaped screwdriver blade, deformation of the fastener, or inadvertence. Scratches or gouges in the finish of a panel or other surface thus caused by the blade of a screwdriver during a manufacturing process may make it necessary to rework or scrap an item, which has only been damaged cosmetically by the tool.

Abrasion and scratching of a finished surface may also occur when the end of a socket wrench contacts the surface as it is turned during installation or removal of a bolt or a nut. Rotation of the end of the socket wrench against the surface may leave circular scratches in the finish around the fastener that are unacceptable in appearance. If the scratches extend through a protective coating of paint, exposing the underlying metal surface, they may create an increased likelihood of corrosion or oxidation. Rework costs to correct damage caused by tools in the above-described manner are significant, exceeding several millions of dollars per year.

Powered fastener tools, for example, socket wrenches used with pneumatic drives, can subject an operator's hand to potential injury when grasped loosely in one hand to guide or steady the tool in engagement with a fastener. In addition, since an operator must handle a fastener tool during its use, his hands are subject to potentially painful contact with the tool if it is extremely cold or hot as a result of ambient conditions or due to contact with and thermal conduction between hot or cold components, such as hot spark plugs or bolts. Consequently, it may be difficult for the operator to grasp and guide a socket wrench or other tool onto the head of the fastener, or uncomfortable to hold the tool in place while the fastener is rotated. Particularly under extreme cold conditions, the operator's fingers may become so numb due to contact with cold tools that even simple operations are difficult. In addition, vibration transmitted through a socket wrench from a powered driver as the spinning socket is loosely supported in the operator's hand can induce carpal tunnel syndrome, i.e., nerve damage in the hand/wrist area or otherwise cause discomfort to the operator.

Poor lighting in a work area often hampers selection of the proper size tool needed for a job. Thus, for example, an operator may be forced to pick up and closely examine several socket wrenches before finding the one that fits a particular bolt or nut. Sizing inscriptions on tools may become covered with dirt or grease, forcing a trial-and-error approach to choosing the correct size tool.

In consideration of these problems it is an object of this invention to protect an underlying surface from damage caused by contact with a fastener tool. A further object is to prevent a fastener tool from slipping from the head of a fastener and gouging or scratching an underlying adjacent surface. Yet a further object is to stabilize a fastener tool relative to the fastener with which it is used. These and other objects and advantages of the present invention will be apparent from the attached drawings and the Disclosure of the Preferred Embodiments, which follow below.

SUMMARY OF THE INVENTION

In accordance with this invention, apparatus are provided for protecting an underlying surface from contact with a tool used to rotate a threaded fastener. The apparatus includes a sleeve sized to fit over the tool and having a resilient cushion disposed at one end, proximate a portion of the tool that engages the threaded fastener. Also included are means for retaining the sleeve on the tool, which are provided with bearing means permitting the sleeve to remain stationary against the underlying surface as the tool is rotated. The surface is thus protected from abrasion that would otherwise occur due to contact with the rotating tool.

The resilient cushion comprises an annular ring that is seated in a groove formed on the end of the sleeve. In one embodiment, a relatively thin lip, disposed at the same end of the sleeve as the resilient cushion, extends radially inward, supporting the tool. Since the inner surface of the sleeve and lip is relatively smooth, the end of the tool rides freely on the lip as the tool is rotated, the lip thus comprising the bearing means noted above.

In one aspect of the invention, the retaining means comprise an interference fit of the sleeve over an outer circumference of the tool. To enable the sleeve to elastically distort radially outward as the tool is inserted into the sleeve, the retaining means may comprise a plurality of open-ended slots extending along a longitudinal axis of the sleeve, disposed at the end opposite the resilient cushion.

In another embodiment, the retaining means comprise a snap ring that engages a groove formed around the inner circumference of the sleeve. The outer circumference of the tool may include a matching groove corresponding to the groove on the inner circumference of the sleeve. As the tool is inserted into the sleeve, the snap ring seats in the one groove until the two grooves are aligned, at which point the snap ring engages both grooves preventing further longitudinal motion between the tool and the sleeve. In this embodiment, the bearing means comprise the snap ring seated within the grooves.

In a further embodiment, the sleeve comprises a radially inner race of a ball bearing; the resilient cushion is attached to a radially outer race of the ball bearing. An interference fit holds the inner race in place around the tool, so that as the tool is turned it rotates within the ball bearing.

The sleeve comprises a resilient sheath in yet a further embodiment. A resilient bead disposed on the end of the sheath opposite that at which the resilient cushion is disposed is elastically stretched around the exterior of the tool to retain the sheath in place. Interposed between the resilient cushion and the end of the tool that engages the threaded fastener is a load-bearing washer. A material is used for the load bearing washer that has a relatively low coefficient of friction, enabling the tool to freely rotate within the sleeve.

Another aspect of the present invention is directed to the provision of means for thermally insulating the fastener tool to reduce heat transfer between the operator's hands and at least a portion of the fastener tool normally supported by the operator as the fastener tool rotates. Such thermal insulation means can comprise a foam sheath that covers an outer surface of the sleeve comprising the surface protective fastener tool. The foam sheath also reduces transmission of vibration between the tool and the operator's hand.

The sheath or sleeve may be color coded to identify a size of the fastener with which the fastener tool is intended to be used. Furthermore, the sheath or sleeve may incorporate a substance that emits light so that the tool may be located in a poorly illuminated work area.

For use in driving screws, the apparatus further includes an insert molded to fit around the portion of the tool that engages the fastener. The insert is freely rotatable inside the sleeve, and includes a cavity shaped to accommodate the head of the threaded fastener, preventing the tool from slipping out of engagement with the threaded fastener.

DESCRIPTION OF THE PREFERRED EMBODIMENTS

Figure 1:
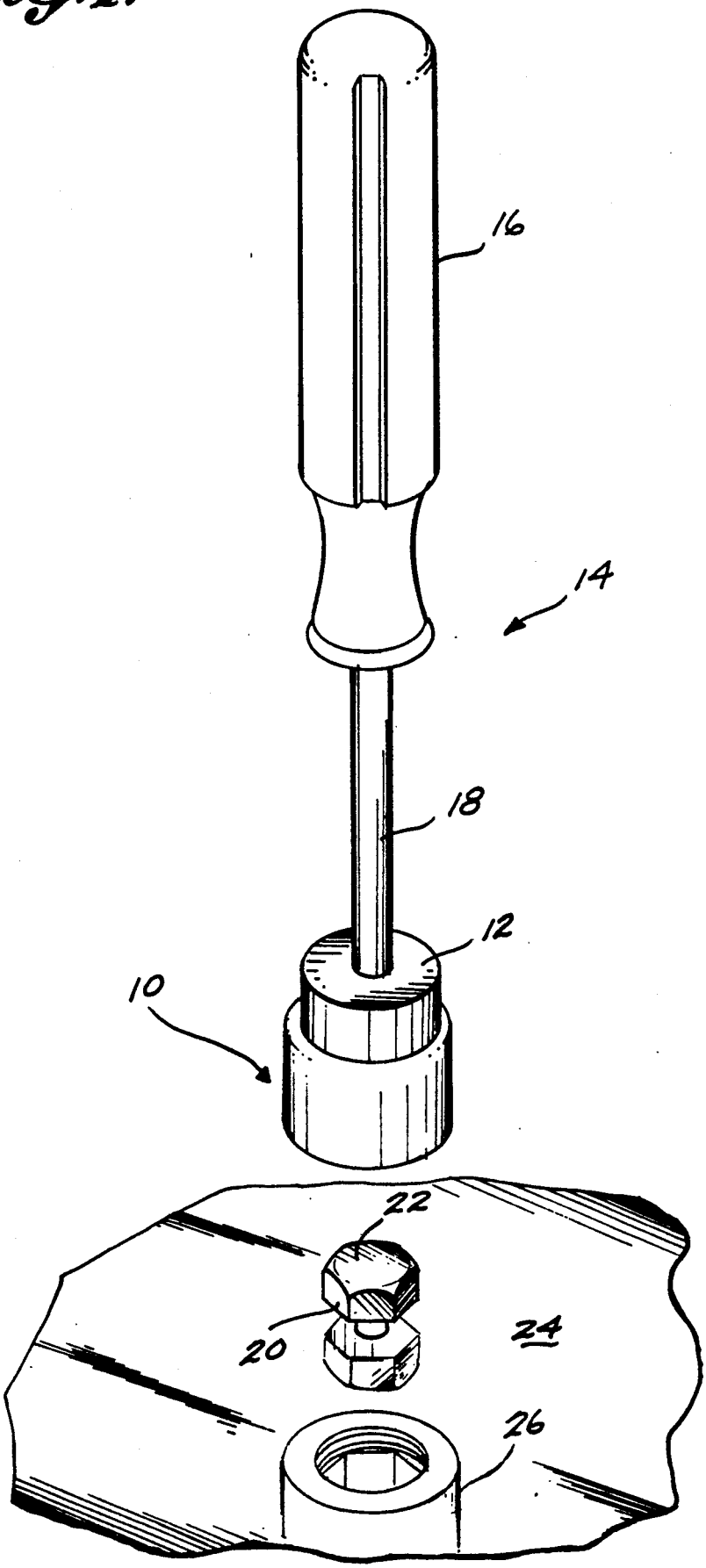
FIG. 1 shows a first embodiment of the present invention in an isometric view, illustrating its application to a socket wrench/driver used for turning a hex head threaded fastener.

FIG. 1 illustrates application of a first embodiment of the surface protective fastener tool, generally denoted by reference numeral 10, to a generally conventional socket wrench 12. As shown in the drawing, a handheld driver tool 14 is used to apply a rotational torque to socket wrench 12 to install or remove a threaded fastener 20. The handheld driver tool includes a handle 16, which is normally grasped in the hand of the user and rotated in the manner of a conventional screwdriver. The handle is attached to a shank 18, the lower end of which is inserted into the socket wrench 12. In this and each of the other following embodiments involving a socket wrench, it will be understood that a ratchet wrench handle, speed driver, or flex handle may also be used to turn the socket wrench in lieu of handheld driver 14. Furthermore, handheld driver 14 may be replaced by a pneumatic or electric motor drive.

Threaded fastener 20 has a conventional hex shaped head 22, and socket wrench 12 is appropriately sized to engage the head. The threaded fastener is partially threaded into a finished surface 24 having a generally glossy or polished sheen, as indicated in the Figure by the inclusion of a reflection 26. Accordingly, it should be apparent that engaging head 22 of the threaded fastener with a socket wrench not provided with the surface protective fastener tool could result in marring of surface 24 as the socket wrench is rotated to tighten or loosen the threaded fastener. Extreme care would be necessary to avoid such marring, requiring that the operator elevate the lower end of the socket wrench away from the finished surface, while retaining it in engagement with the head of the threaded fastener. The present invention eliminates the need for such care, by protecting surface 24 from damage as socket wrench 12 is rotated.

Figure 2:
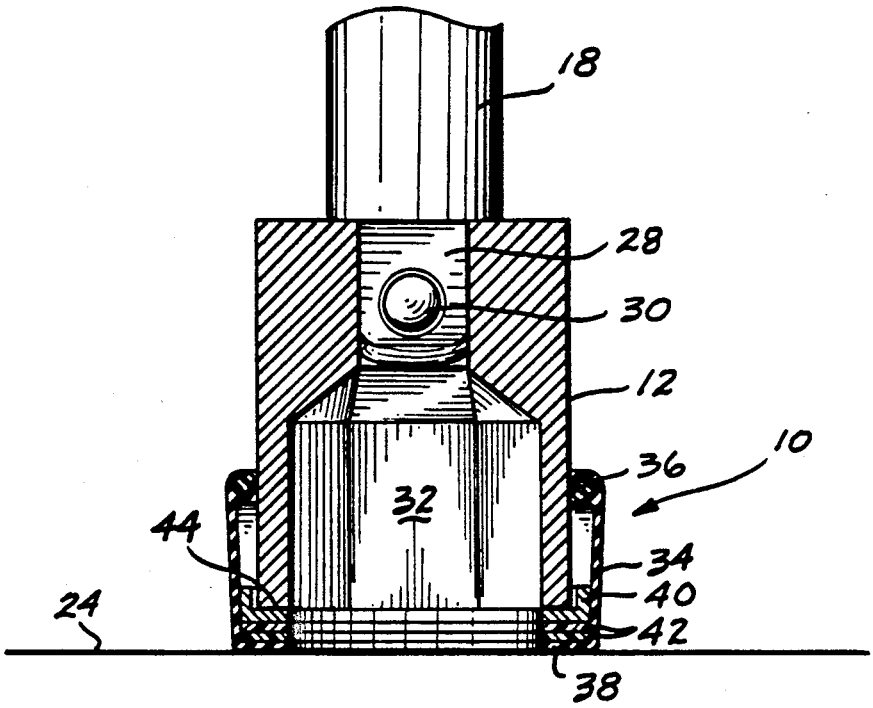
FIG. 2 is a cross-sectional elevational view of the first embodiment of the invention.

Details of the first embodiment of the surface protective fastener tool are shown in cross section in FIG. 2. Only a portion of shank 18 of handheld driver tool 14 is illustrated. The lower end of shank 18 includes a driver tang 28, which is generally rectangular in cross section, having a spring biased ball 30 captively disposed on one of its four sides. A plurality of depressions (not shown) are provided on the mating inner surfaces of socket wrench 12 to retain the socket wrench on driver tang 28, as is well known to those of ordinary skill in the art. Socket wrench 12 includes a hex shaped cavity 32 sized to fit the head of the threaded fastener with which the socket wrench is to be used; however, the present invention is equally suited for use with a 12-point socket wrench.

Surface protective fastener tool 10 comprises an elastomeric sheath 34, which is generally cylindrical in shape, and which is formed from vinyl plastic or other similar resilient flexible material, such as rubber. The upper end of sheath 34 includes an elastic annular bead 36. Prior to installation on the tool, bead 36 has a diameter that is slightly less than the outer diameter of socket wrench 12; however, bead 36 may be stretched to slide over the outer circumference of socket wrench 12, and it provides sufficient friction to retain sheath 34 on the lower end of socket wrench 12. Sheath 34 also includes a resilient cushion 38, formed as a lip that extends inwardly below a lower end 44 of socket wrench 12. Resilient cushion 38 comprises the same material as sheath 34, and is integral with it. An annular ring 40, having an "L" shape cross section is fitted inside sheath 34, disposed adjacent lower end 44 of socket wrench 12, when sheath 34 is fitted in place on the tool. One or more washers 42 are interposed between annular ring 40 and resilient cushion 38, forming a bearing on which lower end 44 of the socket wrench may turn as the wrench is rotated to loosen or tighten a threaded fastener engaged by hex shaped cavity 32. Washers 42 preferably comprise a material having a relatively low coefficient of friction, such as TEFLON TM, to ensure that socket wrench 12 turns freely within the sheath as the socket wrench is rotated. The outer surface socket wrench 12 is sufficiently smooth so that it rotates within elastic annular bead 36. The diameter of the elastic annular bead 36 is sized to fit sufficiently snugly around the outer circumference of socket wrench 12 to hold sheath 34 in place, but not so tightly as to prevent free rotation of the socket wrench.

As illustrated in FIG. 2, lower end 44 of socket wrench 12 is separated from surface 24 by the combined thickness of resilient cushion 38, two washers 42 and annular ring 40. In the preferred embodiment, the total thickness of these elements is substantially less than shown in the drawing figure, e.g., less than 4 mm. In fact, washers 42 may be entirely eliminated if annular ring 40 comprises the material used for washers 42. However, if washers 42 are provided, annular ring 40 is preferably formed from metal.

Figure 3:
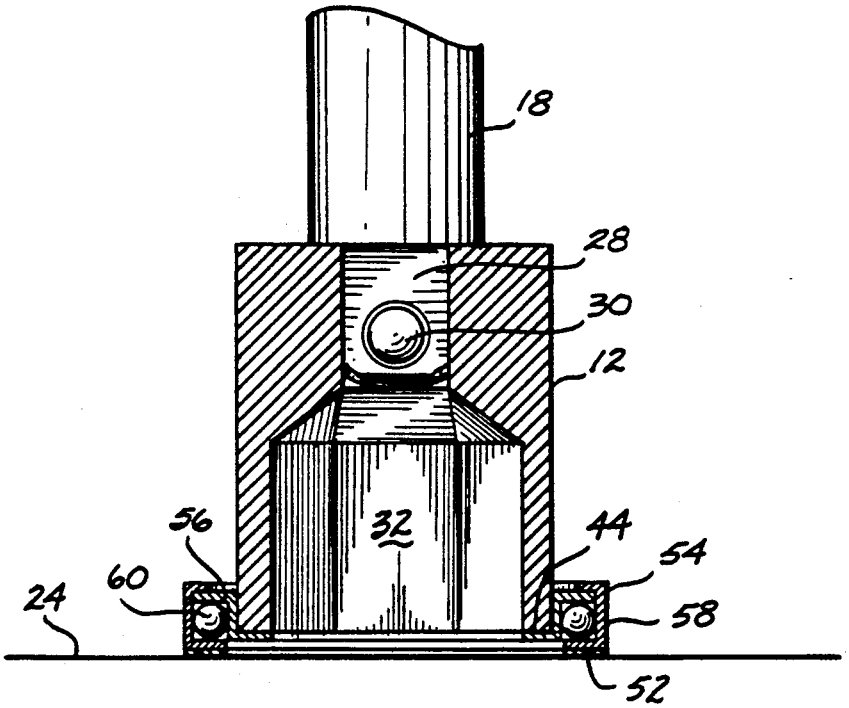
FIG. 3 is a cross-sectional elevational view of a second embodiment of the invention.

A second embodiment of the surface protective fastener tool is illustrated in FIG. 3. In this and the other figures, the same reference numerals are used for different embodiments to indicate elements having the same shape and function. Thus, for example, in the second embodiment, shank 18 is connected to socket wrench 12 by insertion of driver tang 28 having a spring biased ball 30 to hold the socket wrench in place, just as was described with respect to the first embodiment. The second embodiment, generally denoted by reference numeral 50, comprises a ball bearing assembly 54, having an inner race 56, which is pressfit over the lower end 44 of socket wrench 12. The ball bearing assembly thus comprises a relatively short sleeve fitted around the lower end of the socket wrench, which carries the force exerted by the user, directed toward the underlying finished surface 24, as the socket wrench is rotated to turn a threaded fastener. A threaded fastener is not shown in FIG. 2, but it will be understood that socket wrench 12 includes a hex shaped cavity 32 (or is of 12-point design), sized to engage the hex head of the threaded fastener. Ball bearing assembly 54 also includes an outer race 58, having generally a "U" shape cross section, which is fitted over inner race 56, trapping a plurality of ball bearings 60 therebetween. The lower surface of one of the sides of outer race 58 is covered with a resilient cushion 52, comprising a relatively soft elastomeric material, such as vinyl or rubber, formed in a flat annular ring. Resilient cushion 52 is attached to outer race 58 using a suitable adhesive, or by thermally bonding the material to the metal forming the outer race. The resilient cushion has a relatively high coefficient of friction, so that it does not slip when seated against surface 24.

As socket wrench 12 is turned, inner race 56 also rotates, while outer race 58 remains stationary, being in contact with underlying finished surface 24. Ball bearings 60 transfer the load directed toward the finished surface from inner race 56 to outer race 58, and the resilient cushion attached to outer race 58 protects the underlying surface from possible damage due to contact with end 44 of the socket wrench.

Figure 4:
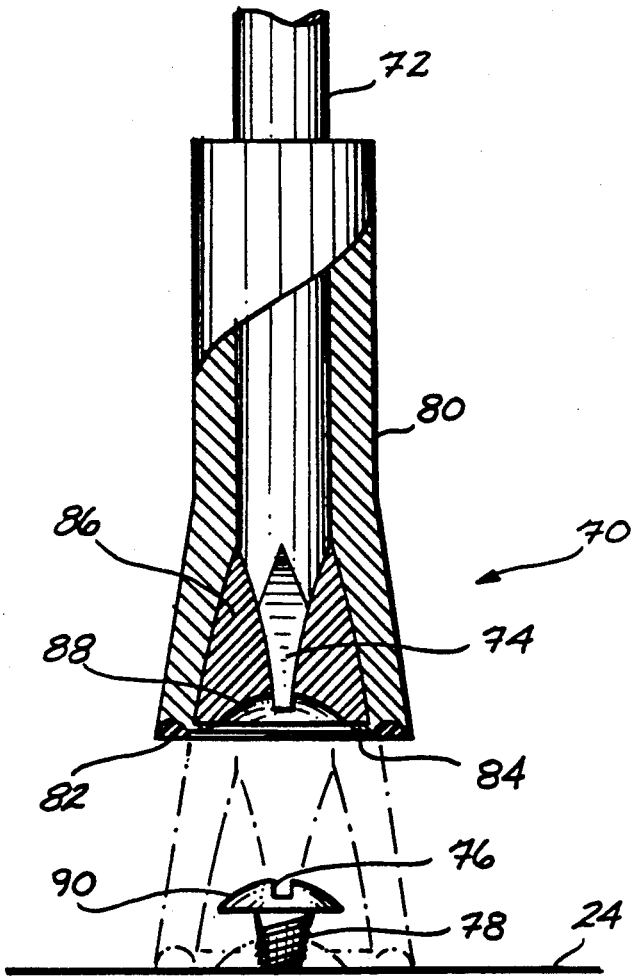
FIG. 4 is a cutaway elevational view of a third embodiment of the invention, adapted for use with a screwdriver.

Turning now to FIG. 4, a third embodiment of the present invention is disclosed, generally denoted by reference numeral 70. The third embodiment is intended for use with various kinds of screwdrivers, including the illustrated type having a shaft 72 on the end of which is formed a straight blade 74. The end of blade 74 is appropriately sized to engage a slot 76 formed in a screw 78, as shaft 72 is rotated to drive or remove the screw from the underlying surface 24. Although not shown in FIG. 4, a handle such as handle 16 (illustrated in FIG. 1) is connected to the other end of shaft 72.

The third embodiment includes a cylindrically-shaped sleeve 80, which is fitted around shaft 72, and which flares radially outward at the lower end, proximate blade 74 of the screwdriver. A resilient cushion 82 is adhesively bonded in a groove formed on the lower end of sleeve 80. Extending radially inward from sleeve 80, at a point adjacent resilient cushion 82, is an annular lip 84. Annular lip 84 serves to retain an insert 86 that is fitted within sleeve 80 and which is molded around the tip of blade 74. Insert 86 rotates with shaft 72 and blade 74 as the screwdriver is turned to rotate screw 78. The outer surface of insert 86 is relatively smooth. Since shaft 72 is round and smooth (except where it is flattened to form blade 74), the shaft rotates freely within sleeve 80 as the screwdriver shaft is turned. The bottom portion of insert 86 includes a concave cavity 88, shaped to conform to a head 90 of the screw, and sized so that only the very tip of blade 74 is exposed to engage slot 76.

FIG. 4 also illustrates in phantom view the relative position of the surface protective fastener tool after screw 78 has been fully driven into underlying surface 24. From the phantom view, it should be clear that resilient cushion 82 carries force directed toward underlying finished surface 24, helping to stabilize blade 74 in alignment with head 90 and slot 76 of screw 78. In addition, the shape of cavity 88 tends to lock blade 74 within slot 76, preventing it from slipping off the fastener and marring underlying surface 24. Even if blade 74 slips from the head of the screw, resilient cushion 72 prevents any damage to finished surface 24 that might otherwise occur due to gouging or scratching by blade 74. In the preferred embodiment, sleeve 80 may be formed of plastic or metal, and resilient cushion 82 preferably comprises an "O" ring, formed of natural or synthetic rubber, or soft plastic.

While a conventional straight blade 74 is shown in the preferred embodiment of FIG. 4, other types of screwdriver blade configurations may be used, e.g., Phillips, TORX TM, Allen, etc. Similarly, cavity 88 may be formed for use with screws and other threaded fasteners having a different shape than that illustrated in FIG. 4.

Figure 5:
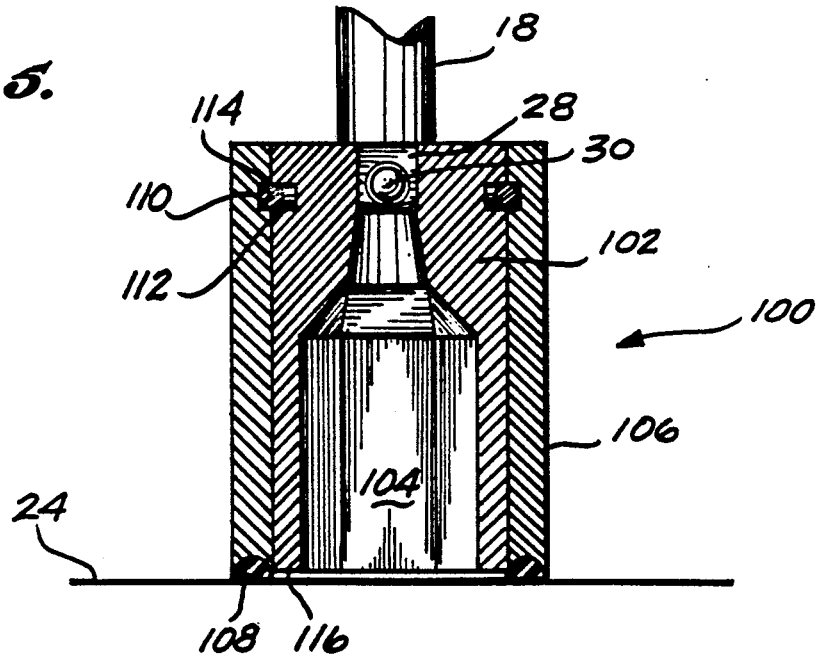
FIG. 5 is a cross-sectional elevational view of a fourth embodiment, used with a modified socket wrench.

In FIG. 5, a fourth embodiment of the surface protective fastener tool is identified by reference numeral 100. In this embodiment, a conventional socket wrench 102 having a hex shaped (or 12-point) drive cavity 104, is rotated as shank 18 is turned. Fitted around socket wrench 102 is a cylindrically shaped sleeve 106. The lower end of sleeve 106 includes a resilient cushion 108, comprising a rubber or plastic "O" ring bonded into a groove having a semicircular cross section. Proximate the upper end of sleeve 106, on its inner circumference, is machined an annular groove 110. A corresponding annular groove 112 is machined around the outer circumference of socket wrench 102 at an appropriate distance from its lower edge 116, so that grooves 110 and 112 are aligned when lower edge 116 is spaced apart from an underlying finished surface 24 on which sleeve 106 is resting. Sleeve 106 is locked in place around the outer circumference of socket wrench 102 by a snap ring 114, which is seated within grooves 110 and 112. The depth of groove 112 is equal or greater than the radial thickness of snap ring 114, enabling the snap ring to be temporarily compressed, so that it is fully seated within groove 112 as sleeve 106 is slid over the outer circumference of the socket wrench. Once grooves 110 and 112 are aligned, snap ring 114 expands radially outward, locking the grooves in that position. Alternatively, the depth of groove 110 may be equal or greater than the radial thickness of snap ring 114, so that the snap ring is temporarily distended radially outward into groove 110 as the socket wrench is slid into engagement with sleeve 106, snapping back between the two grooves after they are aligned. The radial thickness of snap ring 114 is slightly less than the width of the grooves, providing sufficient clearance to permit the socket wrench to rotate in sleeve 106.

Grooves 110 and 112 and snap ring 114 serve as a bearing mechanism that permits sleeve 106 to remain stationary against surface 24 as socket wrench 102 is rotated. Resilient cushion 108 protects surface 24 from contact and abrasion by lower edge 116 of the socket wrench as it is rotated within the sleeve.

In an alternative arrangement (not shown) sleeve 106 is provided on its lower edge 116 with a lip (similar to lip 84 shown in FIG. 4) that extends radially inward below the lower edge of socket wrench 102. The upper portion of sleeve 106 is extended in length, beyond the upper end of socket wrench 102 and includes an annular groove similar to groove 110, which is disposed in alignment with the top end of the socket wrench. Snap ring 114 is radially expanded into the above-described groove, locking the sleeve in place on the socket wrench, yet permitting relative rotation between the two.

Figures 6, 7:
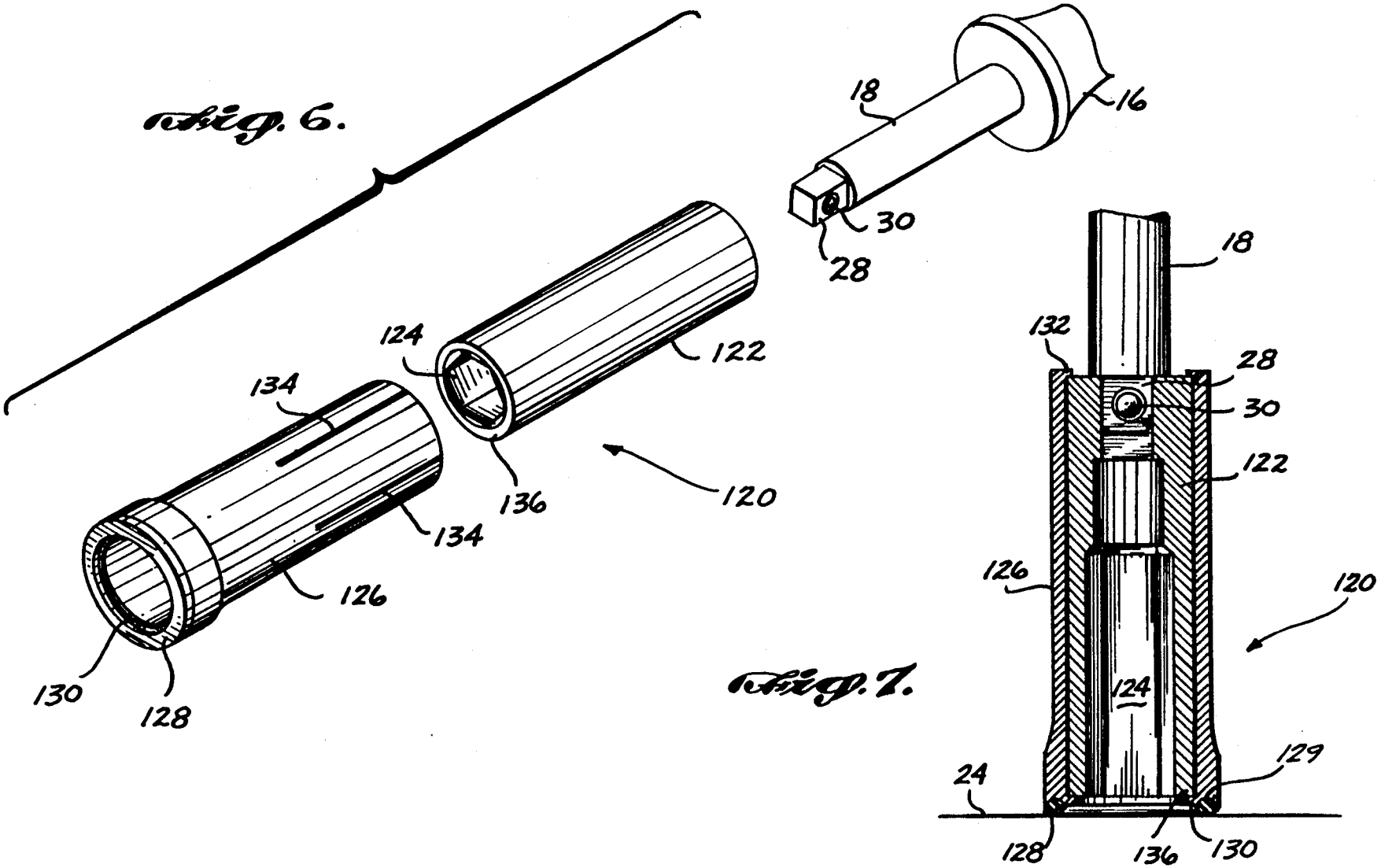
FIG. 6 is an exploded isometric view of a fifth embodiment of the invention.
FIG. 7 is a cross-sectional elevational view of the fifth embodiment.

FIGS. 6 and 7 illustrate a fifth embodiment of the surface protective fastener tool, denoted by reference numeral 120, which is used with a relatively deep socket wrench 122. Socket wrench 122 includes a hexagonal drive cavity 124 (or a 12-point drive cavity), and is thereby adapted to engage a nut threaded on a stud (not shown, which extends into the drive cavity). Drive shank 18 engages socket wrench 122 as disclosed above, transferring rotational driving force to it. A sleeve 126 is fitted around the exterior of socket wrench 122, and includes a resilient cushion 128, comprising a rubber or plastic "O" ring seated within a groove 129 having a semispherical cross section, which is disposed on the lower end of the sleeve, as previously described above with respect to other embodiments. Adjacent resilient cushion 128 is disposed a lip 130, extending radially inward in support of a lower edge 136 of socket wrench 122. Lip 130 thus transfers force directed towards surface 24 to sleeve 126. This force is carried by resilient cushion 128. The surface of lip 130 on which socket wrench 122 rests is polished, so that the socket wrench turns freely within sleeve 126. A second lip 132 is formed on the opposite end of sleeve 126, extending above the upper end of socket wrench 122.

Four slots 134 are formed in sleeve 126, extending longitudinally from its upper end. Slots 134 thus define four flexible "fingers," which deflect outwardly, enabling sleeve 126 to slip over the exterior of socket wrench 122. The radially inner edge of lip 132 thereby slides over the outer surface of the socket wrench, until seated above its upper end. Once socket wrench 122 is seated between lips 130 and 132, it is held in place in sleeve 126 by the interference fit of the lips; however, the socket wrench is free to rotate within the sleeve as shank 18 is turned. As previously described, resilient cushion 128 rests on underlying finished surface 24, protecting it from abrasion due to contact with the lower edge of socket wrench 122 as it is rotated.

Figure 8:
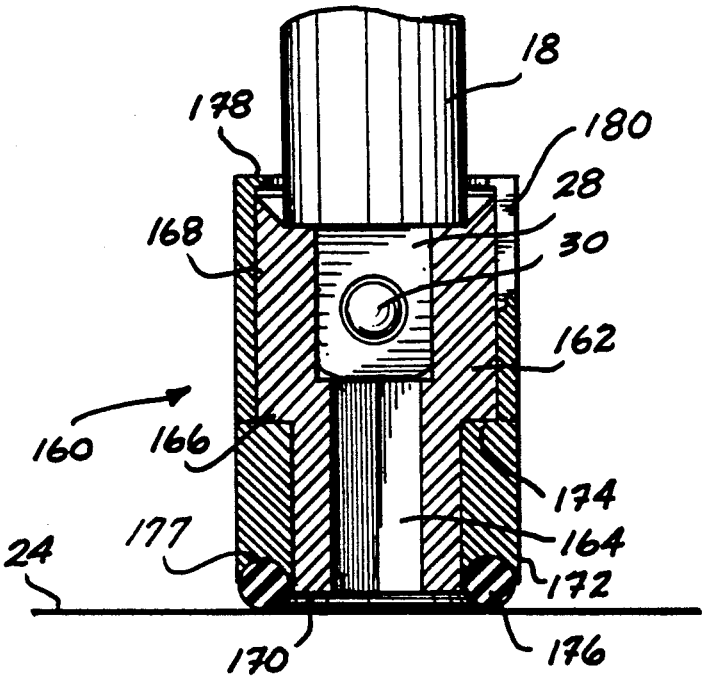
FIG. 8 is a cross-sectional elevational view of a sixth embodiment.

A sixth embodiment of the surface protective fastener tool is identified by reference numeral 160, as shown in FIG. 8. It is similar to surface protective fastener tool 120 of FIGS. 6 and 7, except that it is used with a socket wrench 162, which has a substantially smaller hexagonal cavity 164, designed to accommodate threaded fasteners having relatively smaller hexagonal heads than in the preceding embodiments. Socket wrench 162 is necked down around hexagonal cavity 164, to a diameter that is substantially less than the diameter of its upper portion. The change in diameter between the lower portion in which the cavity is formed and upper portion 168 defines a shoulder 166. A sleeve 172 is sized to fit around the outer circumference of socket wrench 162 and includes an internal shoulder 174, which engages shoulder 166 on socket wrench 162, supporting it so that a lower edge 170 of the socket wrench does not contact underlying finished surface 24. Force directed towards the finished surface is thereby transferred to sleeve 172, and thus to a resilient cushion 176, which is adherently secured within a groove 177 formed on the lower end of sleeve 172. As in other embodiments, resilient cushion 176 comprises an "O" ring held in place in groove 177 by a suitable adhesive. The upper end of sleeve 172 includes a lip 178, extending radially inward above the upper end of socket wrench 162. As in the preceding embodiment, four longitudinally extending slots 180 (only one shown in cross section) are spaced apart around the upper end of sleeve 172. The slots enable lip 178 to be displaced radially outward as it is slid over the exterior surface of socket wrench 162, until it engages the upper end of the socket wrench in an interference fit as shown in the Figure. Surface protective fastener tool 160 has an advantage as compared to the preceding embodiment, in that a lower lip is not required to support socket wrench 162. As a result, the socket wrench may be used with threaded fasteners having relatively thin heads or with thin nuts. Shoulder 174 in sleeve 172 serves as a bearing surface, permitting free rotation of socket wrench 162 within sleeve 172 as shank 18 is turned. The lower edge 170 of socket wrench 162 is prevented from contacting finished surface 24, and the finish on the surface is thus protected against marring and other damage that might otherwise result from such contact.

Figure 9:
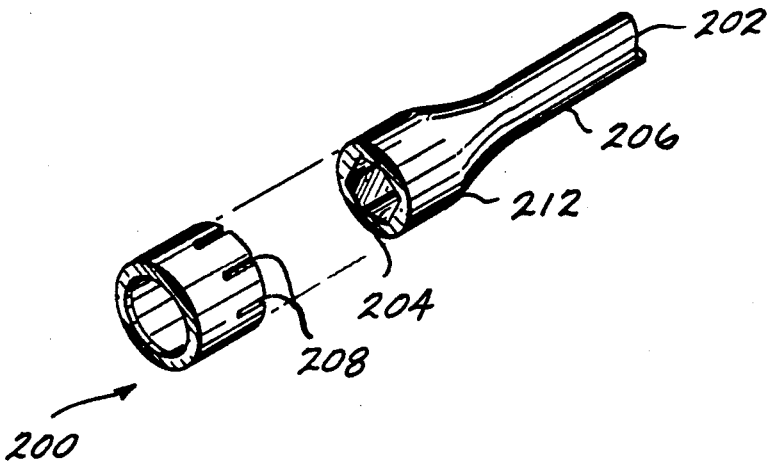
FIG. 9 is an exploded isometric view of a seventh embodiment of the present invention, intended for use on the end of a nut driver, only a portion of which is shown.
Figure 10:
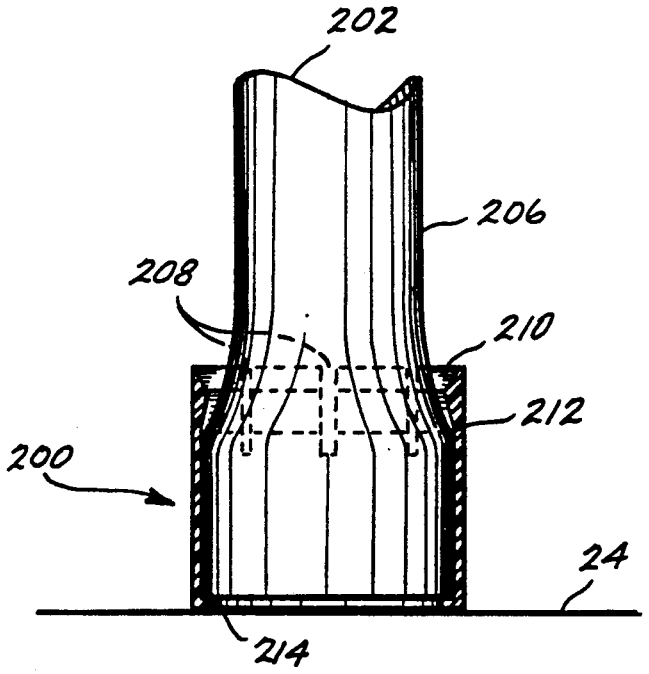
FIG. 10 is a cutaway view of the seventh embodiment, showing it attached to the end of the nut driver.

Turning now to FIGS. 9 and 10, a seventh embodiment of the surface protective fastener tool is shown at reference numeral 200. This embodiment is shown in use with a nut driver 202, but may also be used in conjunction with a socket wrench having a similar necked-down external configuration. The end of nut driver 202 over which surface protective fastener tool 200 attaches includes a hexagonal recess 204, which is sized to accommodate the hexagonal head of a bolt or other fastener (not shown). The end of nut driver 202 in which recess 204 is disposed has a relatively larger diameter than the diameter of a shaft 206 of the nut driver. To facilitate attachment of the surface protective tool to nut driver 202, a plurality of slots 208 are formed in one end of the surface protective tool, extending generally in alignment with its longitudinal axis. In addition, the end of surface protective fastener tool 200 in which slots 208 are formed thickens radially inwardly to form a ridge 210. Ridge 210 creates an interference fit as surface protective fastener tool 200 is slipped over the lower end of nut driver 202. Slots 208 allow the end of surface protective fastener tool 200 that includes the slots to flex radially outward, until ridge 210 passes beyond a shoulder 212 on the nut driver so that a lip 214, formed on the other end of the surface protective fastener tool, underlies and abuts the lower end of nut driver 202. A smooth inner surface on lip 214 serves as a bearing to carry force directed along shaft 206, protecting underlying finished surface 24 from abrasion as nut driver 202 is rotated within the surface protective tool.

Figure 11:
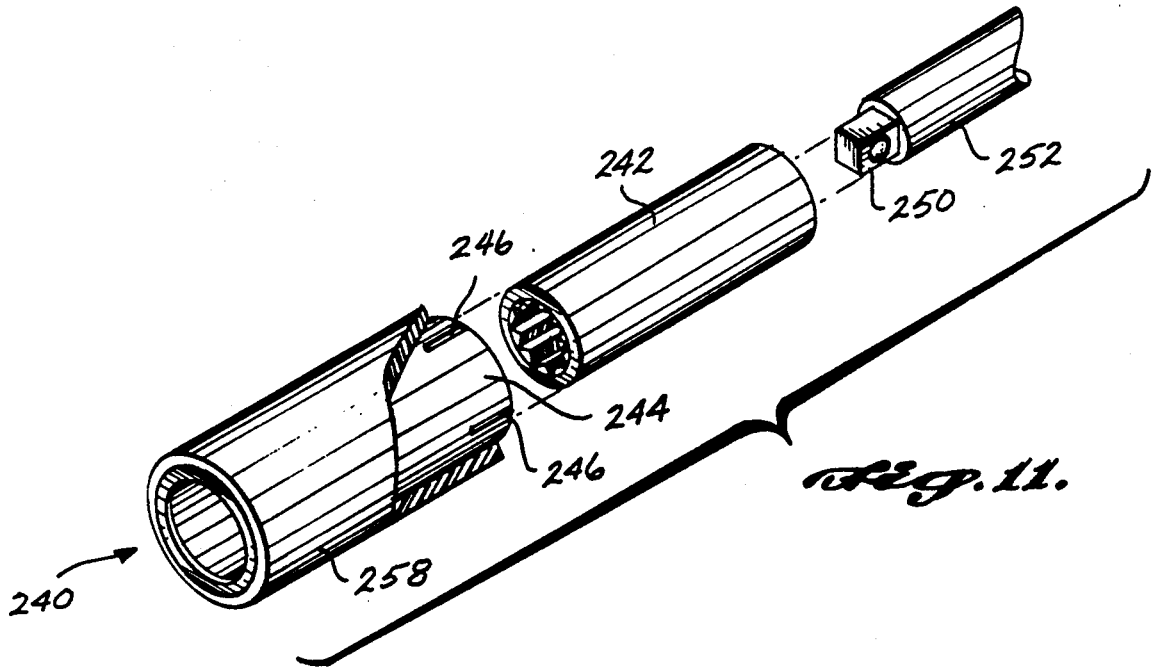
FIG. 11 is an exploded isometric view of an eighth embodiment that is used with a deep socket wrench, and a portion of a drive shaft that engages the deep socket wrench.
Figure 12:
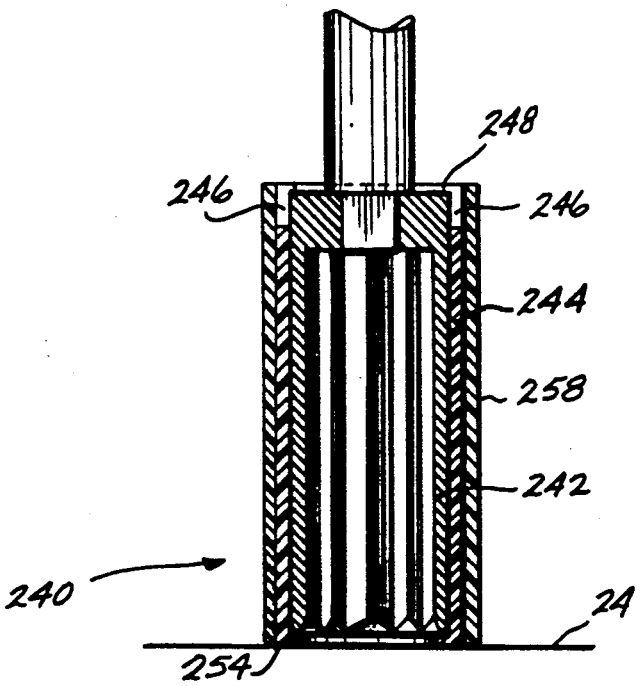
FIG. 12 is a cross-sectional view of the eighth embodiment, illustrating the manner in which the fastener protective tool is attached to the deep socket wrench.

FIGS. 11 and 12 show yet another embodiment of the surface protective fastener tool 240, for use with a deep socket wrench 242. Surface protective fastener tool 240 preferably comprises a sleeve 244 in which a plurality of slots 246 are formed adjacent one end, extending generally in alignment with the longitudinal axis of the device. A lip 248 extends radially inward from the end of the surface protective fastener tool on which slots 246 are formed and loosely secures sleeve 244 in place on one end of socket wrench 242; that end of socket wrench 242 engages a drive tang 250, which is formed on the end of a drive shaft 252. The other end of sleeve 244 includes a lip 254, which extends radially inward over the end of socket wrench 242 that drives a fastener (not shown), acting as a bearing and protecting underlying finished surface 24 from contact with and abrasion by the socket wrench. Slots 246 enable sleeve 244 to deflect radially outward as the inner edge of lip 248 is slid over the exterior surface of socket wrench 242, until lip 248 overlies and engages the end of the socket wrench. Socket wrench 242 is thus free to rotate within sleeve 244 while driving a fastener, without contacting an underlying finished surface 256.

Surface protective fastener tool 240 also includes means for thermally insulating socket wrench 242 from contact with the hand of an operator and for reducing the transmission of vibration from the tool to the operator's hand. The means for thermally insulating socket wrench 242 are disposed around the exterior surface of sleeve 244 and preferably comprise a sheath 258 made of an elastomeric high density foam material having a relatively low thermal conductivity compared to that of the metal from which socket wrench 242 is made. Sheath 258 is adhesively secured to sleeve 244; alternatively, sheath 258 is made slightly undersize relative to the external diameter of sleeve 244 so that it must be stretched to fit over the sleeve in a friction fit. Sheath 258 also provides an improved gripping surface so that an operator's hand can better hold sleeve 244 while socket wrench 242 is turned to rotate a fastener and absorbs vibration that would otherwise be transmitted to the operator's hand from a powered driver (not shown).

Sheath 258 can be color coded to identify the size of the fastener, i.e., bolt or nut, which socket wrench 242 is made to fit. For example, a blue colored sheath 258 might indicate that the socket wrench is sized to fit a 9/16" bolt or nut, while a red colored sheath could indicate that the socket wrench fits a ½" bolt or nut. Furthermore, a phosphorescent or luminescent chemical additive can be incorporated into the high-density foam comprising sheath 258 to cause it to glow or emit light, making it readily visible. The color of the emitted light may be chosen to clearly identify the size of the socket wrench enclosed by the sheath, under low ambient light conditions or in darkened work areas. Suitable chemical additives to obtain this "glow-in-the-dark" property are made by Nemoto Company of Japan and are sold by United Mineral and Chemical Company in the United States. For example, a green glow may be obtained with the additive sold as Green Phosphate, Type 6 SSU. This type of phophorescent chemical additive absorbs ambient light and reradiates it for some time thereafter. The color coding and/or glow-in-the-dark properties of sheath 258 greatly facilitate the use of surface protective fastener tool 240 in poorly lighted areas and/or selection of the proper tool for a job where the size of the fastener tool is not otherwise readily apparent.

Figure 13:
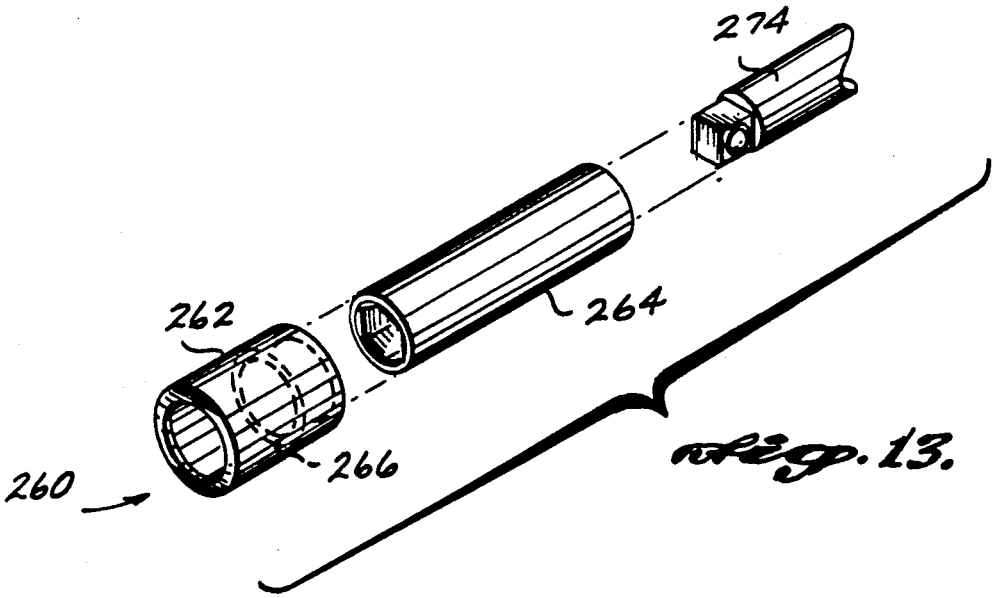
FIG. 13 is an exploded isometric view of a ninth embodiment, also illustrated with respect to its use on a deep socket wrench.
Figure 14:
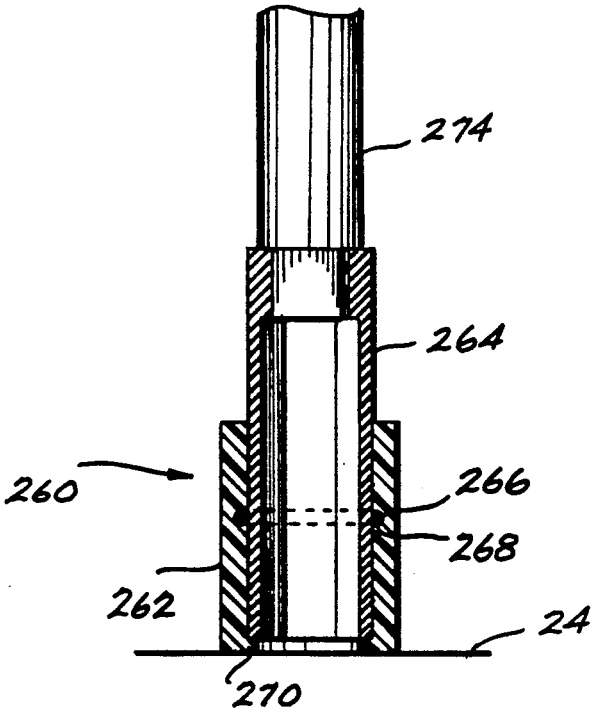
FIG. 14 is a cross-sectional view of the ninth embodiment showing the driver tool mounting on the deep socket wrench.

Yet another embodiment of the surface protective fastener tool, shown in FIGS. 13 and 14 at 260, comprises a sleeve 262, which is held in place on the exterior surface of a deep socket wrench 264 through the tension provided by an inset O-ring 266. O-ring 266 comprises a round (or square) cross section ring of an elastomeric material, such as natural or synthetic rubber, which is inset in a groove 268, formed in the interior wall of sleeve 262. The internal circumference of O-ring 266 is less than the outer circumference of deep socket wrench 264, creating an interference friction fit between the O-ring and the outer surface of the deep socket wrench. A lip 270 formed on the lower end of sleeve 262 extends radially inwardly below the lower end of deep socket wrench 264, providing a bearing surface on which the deep socket rotates, and protecting a finished surface 272 from contact with and abrasion by the end of deep socket wrench 264. A drive shaft 274 engages deep socket wrench 264 to rotate it within sleeve 262, while the sleeve remains stationary against surface 272. Sleeve 262 is readily removed from deep socket wrench 264 and may be used on a socket wrench of a different length, so long as the external diameter is substantially the same as that of deep socket wrench 264.

Like sheath 258 in the preceding embodiment, sleeve 262 may be colored coded and/or made of plastic or other material that incorporates a phosphorescent or luminescent chemical that glows or emits light. The color of the emitted light may be selected in order to identify the size of the fastener, which deep socket wrench 264 is made to fit. In fact, any embodiment of the surface protective tool can be similarly color coded and/or made to glow in the dark, either over a portion or over all of its exterior surface, to facilitate location and selection of the correct size fastener tool for a job.

Figure 15:
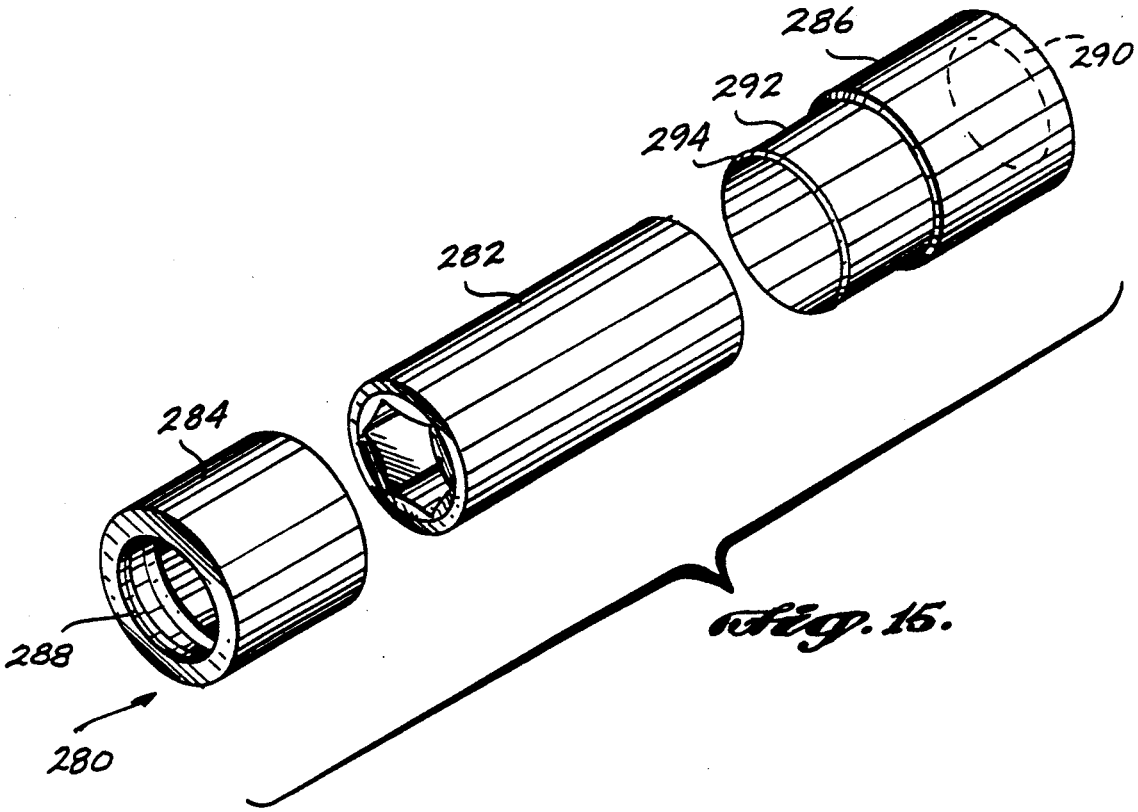
FIG. 15 is an exploded isometric view of a tenth embodiment of the fastener tool, for use with a dual end socket wrench.
Figure 16:
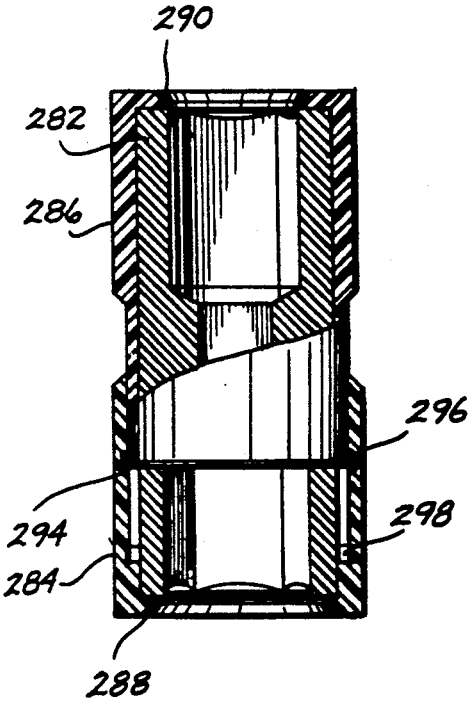
FIG. 16 is a partial cross-sectional view of the tenth embodiment, mounted on the dual end socket wrench.

FIGS. 15 and 16 show another embodiment of the surface protective fastener tool at reference numeral 280, which is used in connection with a dual-end socket wrench 282. While not limited to this type socket wrench, surface protective tool 280 is particularly well adapted for use with the dual-end socket wrench, since both ends of the socket wrench are thus prevented from contacting and abrading an underlying surface. Surface protective fastener tool 280 comprises a cylindrically-shaped outer sleeve 284 and a cylindrically-shaped inner sleeve 286. Outer sleeve 284 includes a lip 288, which extends radially inward overlying one end of dual-end socket wrench 282; similarly, inner sleeve 286 also includes a lip 290, which extends radially inward over the other end of the socket wrench. One end of dual-end socket wrench 282 is sized to engage a different size fastener than is the other end, making it particularly useful, for example, for driving different size wheel lug nuts. Since surface protective fastener tool 280 protects both ends of dual-end socket wrench 282 from contact with an underlying surface, the dual-end socket wrench may be flipped end-for-end to accommodate either size fastener, without requiring removal and reinstallation of the surface protective fastener tool.

At least a portion 292 of inner sleeve 286 has a diameter sized to fit snugly within outer sleeve 284. The end of portion 292 includes a ridge 294, which extends radially outward to engage a groove 296 formed on the inner surface of outer sleeve 284. A second groove 298 is also provided on the inner surface of outer sleeve 284 to accommodate a socket wrench (not shown), which is shorter in length than dual-end socket wrench 282. Ridge 294 engages the appropriate groove 296 or 298 when outer sleeve 284 and inner sleeve 286 are slid over opposite ends of a socket wrench, until lips 288 and 290 contact the opposite ends of the socket wrench. Dual-end socket wrench 282 easily rotates within surface protective fastener tool 280, with the outer surface of either lip 288 or lip 290 held motionless against an underlying surface, the inner surface of the lips acting as a bearing surface for the dual-end socket wrench.

Figure 17:
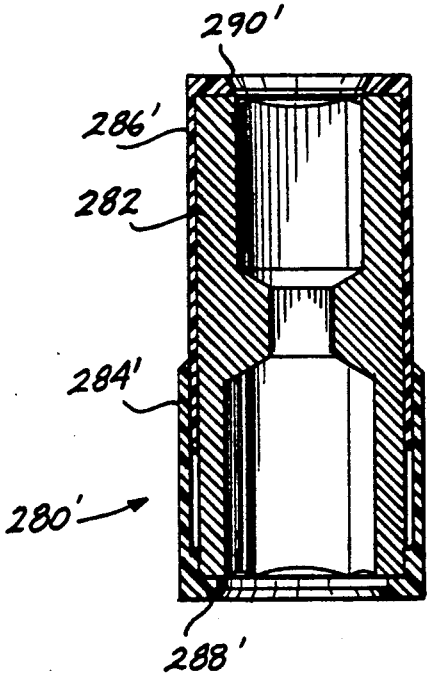
FIG. 17 is a cross-sectional view of an alternative to the tenth embodiment, mounted on the dual end socket wrench.

An alternative embodiment of surface protective fastener tool 280 is shown in FIG. 17, identified at reference numeral 280'. Surface protective fastener tool 280' also comprises an outer sleeve 284' and an inner sleeve 286'. Similarly, lips 288' and 290' extend radially inward from outer sleeve 284' and inner sleeve 286', respectively, overlying opposite ends of dual-end socket wrench 282. However, surface protective fastener tool 280' may be used with socket wrenches of varying length, since it does not include a ridge 294 nor grooves 296 and 298, as does surface protective fastener tool 280. Instead, inner sleeve 286' engages outer sleeve 284' in a friction fit, as the inner sleeve is slid longitudinally inside the outer sleeve. The friction between inner sleeve 286' and outer sleeve 284' is sufficient to prevent the two from disengaging, and thus maintains the surface protective fastener tool in place upon dual-end socket wrench 282. Lips 288' and 290' protect any underlying surface from contact and abrasion by the ends of dual end socket wrench 282 when it is rotated to turn a fastener.

Figure 18:
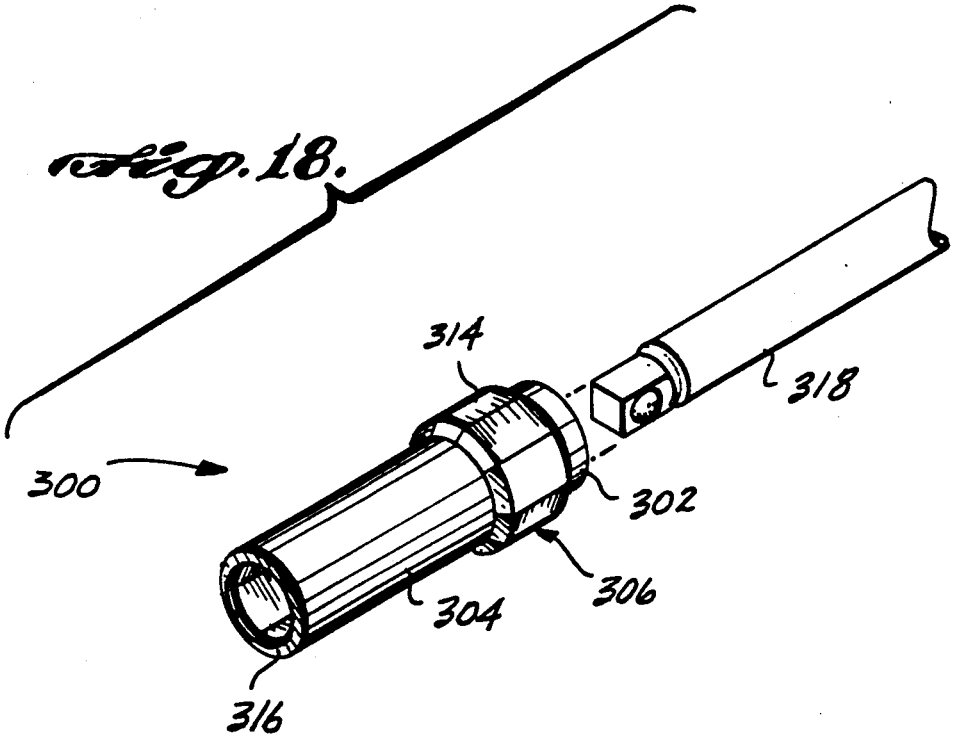
FIG. 18 is an isometric exploded view of yet another embodiment mounted on a socket wrench, with a drive extension.
Figure 19:
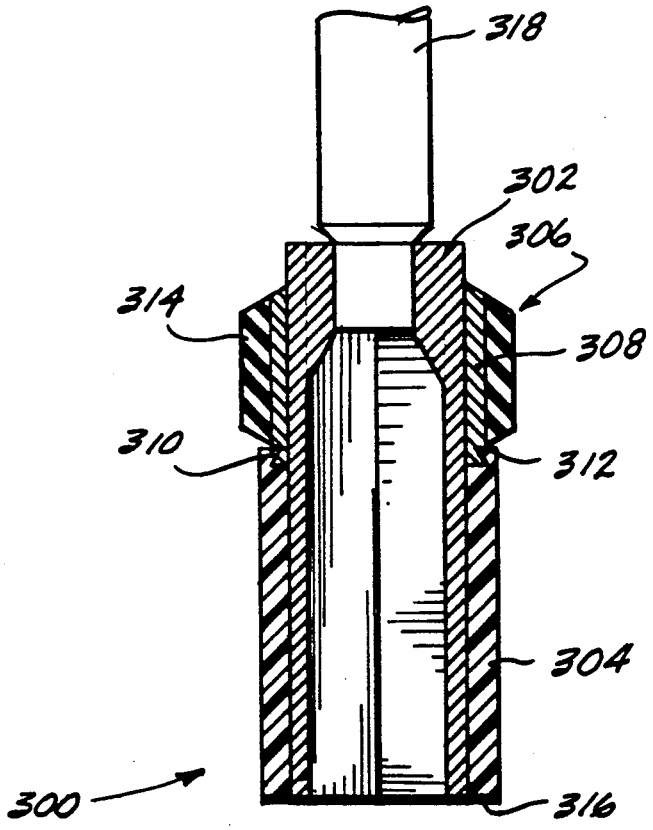
FIG. 19 is a cross-sectional view of the embodiment of FIG. 18 on the socket wrench.

In FIGS. 18 and 19, a final embodiment of a surface protective fastener tool 300 is shown, fitted over a socket wrench 302, which can be rotated with a ratchet handle (not shown) by turning a drive extension 318. Surface protective fastener tool 300 includes a sleeve 304 that is rotatably attached to an annular member 306. Annular member 306 comprises an inner ring 308, preferably made of metal, which is press fit over the outer circumferential surface of socket wrench 302 or otherwise fixedly attached thereto, such as with a suitable adhesive. Formed around inner ring 308 is a groove 310, sized to engage a corresponding ridge 312 that is formed on the inner surface or end of sleeve 304. As a result of the engagement of ridge 312 with groove 310, sleeve 304 is retained on the socket wrench, but the socket wrench and annular member 306 are free to rotate relative to sleeve 304.

Annular member 306 further includes a grip surface 314, which is disposed circumferentially around inner ring 308 and fixedly attached to it, preferably by using a suitable adhesive. In the preferred form of this embodiment, grip surface 314 comprises rubber or other elastomeric material that is readily grasped in an operator's hand and enhances the friction between the hand and the tool to increase the torque applied in manually rotating socket wrench 302 when drive extension 318 (or other drive mechanism) is not being used. Alternatively, grip surface 314 may comprise a knurled metal surface, integral with inner ring 308.

When annular member 306 is attached to socket wrench 302, it is positioned so that one end of sleeve 304 extends even with (or a few mils beyond) the lower distal end of socket wrench 302. An elastomeric cushion 316 is adhesively attached to that end of sleeve 304. The cushion can rest against an underlying finished surface and through sleeve 304, supporting the socket wrench, preventing it from contacting the finished surface as the socket wrench is rotated. Groove 310 and ridge 312 transmit force directed against the socket wrench toward the surface through sleeve 304 and act as a bearing to enable rotation of the socket wrench to turn a fastener. Although sleeve 304 could be provided with an inwardly, radially extending lip that directly supports the socket wrench, this embodiment of the surface protective fastener tool does not require such a lip and thus can engage a thinner nut or fastener (head) than is possible with the other embodiments of the device that use a lip on the sleeve as a bearing surface. Sleeve 304 may alternatively comprise a plastic or other material that is sufficiently soft so that it does not easily scratch a finished surface, in which case, cushion 316 may be omitted, so long as the sleeve extends longitudinally beyond the distal end of the socket wrench.

Each of surface protective fastener tools 200, 240, 260, 280, 280', and 300 may comprise an injection molded elastomeric plastic material, which has a coefficient of thermal conductivity that is substantially less than that of the metal from which the fastener tool, e.g., nut driver or socket wrench, is made. Consequently, the plastic material comprising the sleeve(s) for each of these embodiments of the surface protective fastener tool provides thermal insulation that reduces heat transfer between an operator's hand that is used to grasp or support the device and a fastener tool contained therein, compared to the heat transfer that would normally occur if the metal fastener tool is directly grasped or supported in the operator's hand. However, a thermal insulating sheath such as sheath 258 in FIGS. 11 and 12 may be provided around any of the surface protective fastener tools to further reduce heat transfer between the tool and the operator's hand, better protecting the operator's hand from contact with a rotating fastener tool, and reducing vibration that might otherwise be transmitted between the tool and the operator's hand. The thermal insulation provided by the sheath is particularly beneficial when used in connection with sleeve 244 (or any of the other sleeves) that is made of metal.

While the present invention has been disclosed with respect to several preferred embodiments, those of ordinary skill in the art will understand that modifications beyond those already discussed may be made to the invention within the scope of the claims that follow hereinbelow. Accordingly, it is not intended that the invention be in any way limited by what has been disclosed, but instead that its scope be determined entirely by reference to the claims that follow.

The embodiments of the invention in which an exclusive property or privilege is claimed are defined as follows:

1. Apparatus for protecting an underlying surface from abrasion by contact with a tool used to rotate a threaded fastener, comprising:

a sleeve having a resilient cushion disposed at one end, said sleeve being sized to fit over the tool so that the resilient cushion is proximate a portion of the tool that is used to engage the threaded fastener and extends beyond a distal end of said tool, preventing it from contacting the underlying surface;

means for retaining the sleeve on the tool, including bearing means for supporting the tool to prevent it contacting the underlying surface and permitting the sleeve to remain stationary against the underlying surface as an operator turns the tool within the sleeve to rotate the threaded fastener, said resilient cushion carrying any force directed through the tool against the underlying surface during use of the tool, so that the underlying surface is protected from abrasion that would otherwise occur due to the tool contacting said surface.

2. The apparatus of claim 1, wherein the resilient cushion comprises an annular ring of an elastomeric material.

3. The apparatus of claim 2, wherein the annular ring is seated in a groove formed on the end of the sleeve.

4. The apparatus of claim 1, wherein the sleeve includes a relatively thin lip that extends radially inward from the end of the sleeve at which the resilient cushion is disposed, the lip supporting an end of the tool so that it does not contact the underlying surface and retaining the sleeve on the end of the tool.

5. The apparatus of claim 4, wherein the bearing means comprise the inner surface of said lip, said inner surface being relatively smooth, so that the end of the tool rides freely on the inner surface as the tool is rotated.

6. The apparatus of claim 5, wherein the retaining means comprise an interference fit of the sleeve over an outer circumference of the tool.

7. The apparatus of claim 5, wherein the retaining means further comprise a lip that extends radially inward from an end of the sleeve opposite that at which the resilient cushion is disposed, and a plurality of open-ended slots extending along a longitudinal axis of the sleeve from the end at which said lip is disposed, said slots enabling the sleeve to elastically distort radially outward as the tool is inserted into the sleeve.

8. The apparatus of claim 1, wherein the retaining means comprise a snap ring that engages a groove formed around the inner circumference of the sleeve.

9. The apparatus of claim 8, wherein the outer circumference of the tool includes a groove corresponding to the groove on the inner circumference of the sleeve, the radial depth of one of said grooves being equal to at least the radial thickness of said snap ring, so that the snap ring seats in said one groove as the tool is inserted longitudinally into the sleeve until the two grooves are aligned, said snap ring thereby engaging both grooves, preventing further longitudinal movement of the tool relative to the sleeve.

10. The apparatus of claim 9, wherein the bearing means comprise the snap ring and the grooves, the grooves having sufficient clearance relative to the snap ring to permit the tool to rotate in the sleeve.

11. The apparatus of claim 1, wherein the sleeve comprises a radially inner race of a ball bearing, the resilient cushion being attached to a radially outer race of the ball bearing.

12. The apparatus of claim 11, wherein the retaining means comprise an interference fit between the inner race and the exterior of the tool, the inner race being pressfit onto the tool.

13. The apparatus of claim 1, wherein the sleeve comprises a resilient sheath and the retaining means comprise an annular resilient bead disposed on an end of the sleeve opposite that at which the resilient cushion is disposed, said resilient bead being elastically stretched in circumference to fit around the exterior of the tool.

14. The apparatus of claim 1, wherein the bearing means comprise a load bearing annular washer interposed between the resilient cushion and an end of the tool that engages the threaded fastener, said load bearing annular washer comprising a material having a relatively low coefficient of friction, permitting the tool to rotate freely within the sleeve.

15. The apparatus of claim 1, further comprising an insert molded to fit around the portion of the tool that engages the threaded fastener, said insert having a relatively smooth exterior surface rotating freely with the tool inside the sleeve, and including a cavity shaped to accommodate a head of the threaded fastener as the tool engages the head.

16. The apparatus of claim 1, wherein the tool is generally cylindrical and decreases in diameter at a position intermediate its ends, forming a shoulder, said sleeve including a corresponding shoulder along its inner surface, and bearing means comprising the shoulder on the sleeve, the shoulder on the tool freely riding up on the shoulder within the sleeve as the tool is rotated.

17. A surface protective device comprising:

an elastomeric annular ring, sized to fit about a head of a fastener, said elastomeric annular ring being generally nonabrasive and having a relatively high coefficient of friction;

tool means, sized to engage the head of a fastener, for turning the fastener as the tool means are rotated;

sleeve means attached to the elastomeric annular ring, for retaining it on the tool means, proximate an end of the tool means that engages the fastener, and fixedly positioned to extend beyond a distal end of the tool means, said tool means being freely rotatable relative to the sleeve means so that the sleeve means remain stationary as the tool means turn the fastener.

18. The surface protective device of claim 17, wherein the tool means comprise a socket wrench.

19. The surface protective device of claim 18, wherein the sleeve means includes a shoulder extending radially inward, against which the socket wrench rotates, said shoulder carrying force from the socket wrench directed toward the shoulder along the longitudinal axis of the socket wrench.

20. The surface protective device of claim 18, further comprising interference fit means for retaining the sleeve means on the socket wrench.

21. The surface protective device of claim 20, wherein the interference fit means comprises a groove formed on a radially inner surface of the sleeve means and a snap ring that engages said groove.

22. The surface protective device of claim 20, wherein the interference fit means comprise matching grooves formed on a radially inner surface of the sleeve means and on the radially outer surface of the socket wrench, and a snap ring that engages both of said grooves.

23. The surface protective device of claim 20, wherein the interference fit means comprise a plurality of open-ended slots formed in the sleeve means, which are operative to enable the circumference of the sleeve means to be elastically increased, as the socket wrench is inserted within the sleeve means.

24. The surface protective device of claim 18, wherein the sleeve means include elastic means for engaging the socket wrench.

25. The surface protective device of claim 18, wherein the sleeve means comprise a ball bearing connected around an end of the socket wrench that engages the fastener.

26. The surface protective device of claim 18, wherein the socket wrench has a larger diameter at one end than at the other end, the increase in external diameter defining a shoulder, and wherein said sleeve means rotatably engage the shoulder, preventing the smaller diameter end of the socket wrench from contacting an underlying surface as the socket wrench is rotated.

27. The surface protective device of claim 17, wherein the tool means comprise a screwdriver.

28. The surface protective device of claim 27, further comprising an insert molded around a shaft of the screwdriver and having an exterior surface that rotates within the sleeve means with the shaft of the screwdriver, said insert including a cavity that is shaped to conform to the head of a screw fastener, leaving only a distal end of the screwdriver shaft exposed to engage the screw fastener.

29. The surface protective device of claim 28, wherein the cavity holds the screwdriver shaft centered in engagement with the screw fastener, preventing it from slipping out of engagement and abrading an underlying surface.

30. The apparatus of claim 1, wherein the sleeve is color coded to identify a size of the threaded fastener that the tool is intended to rotate.

31. The apparatus of claim 1, wherein the sleeve comprises a chemical substance that emits light, so that the sleeve is readily visible in low ambient light.

32. The apparatus of claim 1, wherein the means for retaining comprise an annular member that is sized to fit around a circumference of the tool and is fixedly attached to the tool, said annular member including said bearing means, and said bearing means being further operative to rotatably engage the sleeve so that the sleeve remains fixed against the underlying surface as the tool and the annular member are both rotated within the sleeve.

33. The apparatus of claim 32, wherein the annular member includes grip means for increasing a torque, which an operator grasping the annular member can exert to manually rotate the annular member and the tool.

34. Apparatus for protecting the hand of an operator grasping a tool used to rotate a fastener from direct contact with at least a portion of the tool, comprising:

sleeve means formed of a resilient material, for enclosing an end of the tool that engages the fastener, said sleeve means including means for thermally insulating the tool to reduce heat transfer between the operator's hand and at least said portion of the tool as it rotates, and bearing means for enabling the tool to rotate while the sleeve means are stationary against the surface;

surface protective means for preventing said end of the tool from contacting an underlying surface; and means for retaining the sleeve means on the tool.

35. The apparatus of claim 34, wherein said means for thermally insulating the tool comprise an elastomeric foam sheath that covers an outer surface of the sleeve means, providing a fixed gripping surface for the operator's hand so that the tool rotating within the sleeve means does not injure the operator and enabling the operator to use the tool without discomfort when the ambient temperature would otherwise cause the tool to be either too hot or too cold to be comfortably grasped by the operator.

36. The apparatus of claim 34, wherein the sleeve means comprise a material that has substantially lower thermal conductivity than the tool, said means for thermally insulating comprising this material, and wherein the material substantially reduces vibration transfer from the tool into the operator's hand.

37. The apparatus of claim 34, wherein the sleeve means are generally cylindrical and wherein the surface protective means comprise a lip that extends radially inward over said end of the tool, between said end and the underlying surface.

38. The apparatus of claim 37, wherein the bearing means comprise a smooth inner surface on the lip against which the tool is free to rotate with minimal friction.

39. The apparatus of claim 34, wherein the means for retaining comprise a ridge formed on a radially inner surface of the sleeve means and having a relatively smaller inner diameter than the diameter of the tool at the point where the ridge is disposed when the sleeve means are fully fitted onto the tool, said ridge engaging the tool in an interference fit.

40. The apparatus of claim 39, further comprising a plurality of spaced apart slots formed in an end of the sleeve means proximate the ridge and extending generally in alignment with a longitudinal axis of the sleeve means, said slots enabling the sleeve means to distort radially outward as the sleeve means are fitted over the tool until the ridge engages the smaller diameter portion of the tool in the interference fit.

41. The apparatus of claim 40, wherein the ridge engages an end of the tool opposite that which is proximate the fastener.

42. The apparatus of claim 34, wherein the means for retaining comprise an elastomeric ring that is fitted into an internal groove of the sleeve means, said elastomeric ring having a smaller internal diameter than the outer diameter of the tool, so that the sleeve means are retained on the tool by the friction between the elastomeric ring and an outer surface of the tool.

43. The apparatus of claim 34, wherein the sleeve means comprise a first and a second sleeve that slide over opposite ends of the tool, one of the first and second sleeves overlapping at least a portion of the outer surface of the other when fitted on the tool, each of said first and second sleeves including a lip extending radially inward over one end of the tool.

44. The apparatus of claim 43, said means for retaining comprising a friction fit between the first and second sleeves where they overlap.

45. The apparatus of claim 43, said means for retaining comprising a circumferential groove formed on an inner surface of one of the first and second sleeves, said other of the first and second sleeves including a ridge that extends radially outward from its end in engagement with said circumferential groove when the first and second sleeves are fitted onto opposite ends of the tool.

46. The apparatus of claim 43, wherein the tool comprises a socket wrench.

47. The apparatus of claim 32, wherein the sleeve means are color coded to identify a size of the fastener that the tool is intended to engage and rotate.

48. The apparatus of claim 32, wherein said sleeve means include means for emitting light so that the sleeve means are visible in low ambient light.

* * * * *